United States Patent [19]

Coy

[11] Patent Number: 5,072,923

[45] Date of Patent: Dec. 17, 1991

[54] USER-FRIENDLY DOCUMENT INPUT

[75] Inventor: Gerald L. Coy, Rochester, N.Y.

[73] Assignee: Xerox Corporation, Stamford, Conn.

[21] Appl. No.: 569,807

[22] Filed: Aug. 20, 1990

[51] Int. Cl.[5] ..... B65H 7/08

[52] U.S. Cl. ..... 271/110; 271/265; 271/118; 271/245; 271/273

[58] Field of Search ..... 271/265, 257, 258, 259, 271/227, 242, 110, 111, 117, 118, 245, 273; 221/15, 16

[56] References Cited

U.S. PATENT DOCUMENTS

| | | | |
|---|---|---|---|
| 3,981,493 | 9/1976 | Klappenecker et al. | 271/10 |
| 4,132,401 | 1/1979 | Gauronski et al. | 271/245 |
| 4,548,401 | 10/1985 | Nishikawa | 271/265 |
| 4,561,644 | 12/1985 | Clausing | 271/34 |
| 4,568,075 | 2/1986 | Bothner | 271/227 |
| 4,728,966 | 3/1988 | Piatt et al. | 346/134 |

FOREIGN PATENT DOCUMENTS

| | | | |
|---|---|---|---|
| 0964354 | 3/1975 | Canada | 221/8 |
| 0673544 | 3/1990 | Switzerland | 221/8 |

*Primary Examiner*—H. Grant Skaggs

*Assistant Examiner*—Carol Lynn Druzbick

[57] ABSTRACT

A method and apparatus for document feeding for improved operator document manual insertion in which a document may be manually initially inserted into a document input area and released. The document is sensed in the document input area by a document sensor, and then automatically clamped in a document feeding nip which is automatically actuated in response to the document sensing, and then the document is automatically fed. Here, a first time delay period is provided between the sensing of the manually inserted document and the automatic clamping of the document. A second time delay is provided between the automatic clamping and the automatic feeding of the document. Preferably the automatic clamping of the document in the feeding nip is with a limited initial nip force sufficiently low to allow manual document retraction without document damage during the second time delay period. Furthermore, preferably the document sensing automatically actuates an operator display, but here a substantial present time delay is provided between the sensing of the manually inserted document by the document sensor and the automatic actuation of the operator display.

5 Claims, 3 Drawing Sheets

USER-FRIENDLY DOCUMENT INPUT

Figure 1:
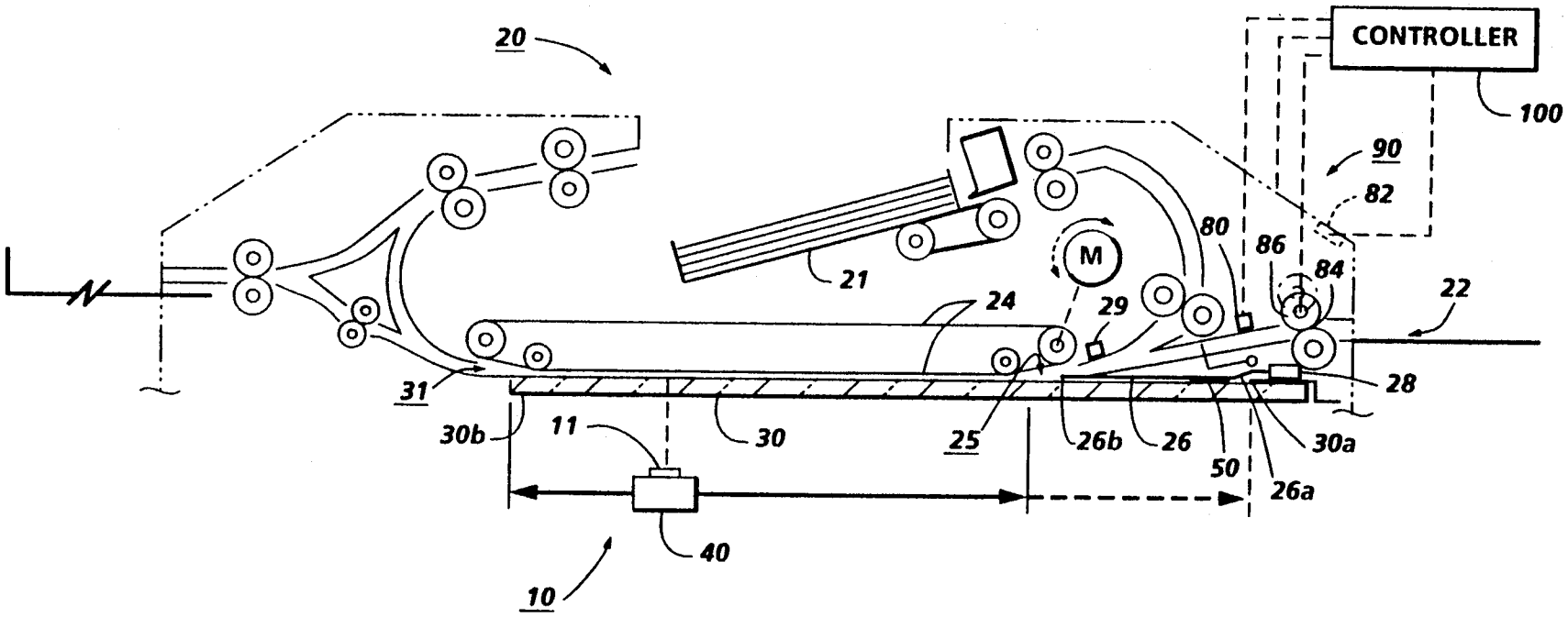

Disclosed is an improvement in sheet handlers in which sheets are manually inserted, especially for either semi-automatic or automatic document feeders for a document imaging system such as a copier or electronic image scanner.

The disclosed system is intended to provide improved user friendliness and less misfeeds, jams or skews over previous systems in which the document in effect may be grabbed and pulled away from the operator without warning or without sufficient alignment time before the operator has released the documents, while it is still being manually inserted into the document feeder. This can be startling to the operator and also may make the operators nervous about putting documents into the unit. Previous manually loaded document handling systems also tend to have problems with misregistration of the document sheet in the input or loading area, particularly if the operator was concerned that the document was going to be grabbed and fed without warning or after only a limited time period, or when an indicator display went on.

There is disclosed in the example herein a preferred control sequence for a document handler in which a manually inserted or fed document is not clamped or nipped until after a first time delay provided after a document input sensor indicates that the document has been initially registered and in the input. Then, after that first time period has passed, the document is clamped for feeding, but preferably with low force, and a second time period is initiated in the same or another timer before actual document feeding. Following this second time period the document is automatically fed by the document handler from the input area to its imaging or other desired position. This overall system allows improperly preregistered or improperly clamped documents in the document input or feeder nip area to be removed by the operator without document damage, and also avoids any need for a jam or fault recovery procedure.

This exemplary disclosed system is particularly suitable for document handlers or feeders of the known type in which the feeding of the document is initiated automatically by inserting the document sheet therein, i.e., without necessarily requiring the operator to press a separate button or switch to feed the document to the image, although that may also be provided, especially for large documents such as computer forms.

As in the example described hereinbelow, as a further desirable feature a time delay may also be provided before the lighting of an indicator lamp or other signal following sensing of the insertion of the sheet, so as to encourage full and deskewed insertion of the sheet. This may be followed by a second time delay, following this visible operator indicia of attempted sheet insertion, before the feeder nip clamps or closes on the sheet, in case the operator needs to or wishes to realign or remove the sheet being inserted.

The disclosed system as shown in the following embodiment, may, if desired, be utilized in the alternative semi-automatic document handler (typically known as the SADH slot) of a dual mode recirculating document handler. Such SADH systems are well known, as disclosed in the references cited herein.

Although a typical or conventional sheet is primarily referred to herein it will be appreciated that the improvement in manual document insertion provided hereby may also be utilized for the initial loading of a computer form or fan fold web (CF), where that is the original document instead of a normal sheet. The CF web may be manually inserted and released by the operator, after it is clamped, so that it does not fall out of the input area. In particular, the disclosed system can provide an improvement in inserting and then holding the lead edge area of a computer form web. This can reduce operator frustration in loading CF documents.

As noted in the prior art, as xerographic and other copiers and document imagers increase in speed, and become more automatic, it is increasingly important to provide higher speed yet more reliable and more automatic handling of the plural document sheets being imaged, i.e., the input to the imager and/or copier.

Although of utility as part of a conventional optical (non electronic imaging) copier document handler, as disclosed herein, the disclosed system may also be desirably used in a system for feeding a set of documents for electronic imaging. The disclosed exemplary document handler or document feeder may desirably, with only minor control function modifications as described herein, be of a desirable known type, well known for use with conventional optical light-lens copiers, although shown here with an electronic document scanner imaging system.

An example of such an electronic document imaging and printing system is disclosed in Xerox Corporation U.S. Pat. No. 4,757,348 issued July 12, 1988 to Rourke, et al and commonly filed U.S. Pat. No. 4,716,438 issued Dec. 29, 1987 That is compatibly usable with the present system, if desired. Among many other examples of platen scanning electronic imaging systems per se are Xerox Corporation U.S. Pat. No. 4,295,167 or related U.S. Pat. No. 4,287,536. The terms copying and imaging are used interchangeably in this particular case.

Disclosed herein by way of example is a well known dual input type of RDH, an RDH/SADH. RDH/SADH is a common abbreviation for a well known type of document handler with a top document loading tray recirculating document handler (RDH) mode and an integral alternative side document entrance or SADH slot providing a semi-automatic document handler (SADH) unidirectional document input. This disclosed RDH system allows documents to be automatically or semi-automatically fed onto an imaging platen from either infeeding position. Examples of patents thereon are cited below. However, this is merely exemplary, and the present invention is not limited to a recirculating or common tray restacking document handler or document feeder.

Also as to specific hardware components of the subject apparatus, it will be appreciated that, as is normally the case, various such specific hardware components are known per se in other apparatus or applications, including that described in art cited herein, and need not be re-described herein. Particularly noted as to the exemplary disclosed document handling system is Xerox Corporation U.S. Pat. No. 4,579,444, issued Apr. 1, 1986 to Pinkney and Sanchez (D/84074), and/or other RDH art cited therein. Said U.S. Pat. No. 4,579,444 patent (or similar U.S. Pat. No. 4,621,801) is of appropriate background interest as illustrating the general nature of the specific embodiment of the disclosed document handlers and platen. Some other examples of prior art recirculating document handlers are disclosed in U.S. Pat. Nos. 4,278,344 issued July 14, 1981 to R. B. Sahay; 4,270,746 issued June 2, 1981 to T. J. Hamlin, and 4,076,408 issued Feb. 28, 1978 to M. G. Reid, et al. Also, in U.S. Pat. Nos. 4,176,945; 4,330,197, 4,466,733; and 4,428,667.

Said U.S. Pat No. 4,076,408 issued Feb. 28, 1978 to M. G. Reid, et al, also includes a separate optical emitter/detector 149,151 in the document tray to detect the presence (loading) or absence of any documents in the tray. A similar disclosure is in U.S. Pat. No. 4,099,860 issued July 11, 1978 to J. L. Connin. More typically, such document tray "document presence" sensors are a conventional integral corner bottom light beam sensor unit, in which a light transmitter on the registration side wall slightly above the tray bottom transmits a light beam downwardly at an angle into an adjacent receiver or sensor in the tray bottom, and this light beam is occluded by any (even one) document sheet in the tray lying on the tray bottom. However, this "document presence" sensor information is normally used to tell the copier controller that the RDH tray mode of operation was in use, or, in clearing a jam, that there was a document to be removed and the reloaded with others in the document tray.

By way of particular interest as background in document feeding registration and manual input sensing there is noted Xerox Corporation U.S. Pat. No. 4,132,401 to Gauronski, et al. (D/75072Q).

A preliminary patentability search also noted the following references, and provided the following comments thereon (these are not comments by Applicant or his representatives):

U.S. Pat. No. 4,548,401 to Nishikawa discloses an apparatus comprising feeding rollers or a feeding belt mechanism which remain inoperative immediately after a sheet supply step. Means for initiating a feeding operation is provided after a margin of time during which a user can correct a position and posture of the sheet.

U.S. Pat. No. 4,561,644 to Clausing, assigned to Xerox Corporation, discloses an apparatus comprising a sensor which detects a lead edge of a sheet fed from a stack as it reaches a retard nip and causes an actuator connected to a frame to pull, thereby rebalancing a feed means. A stack normal force is reduced while the sheet continues to be fed from the stack. If a sensor does not sense a sheet by a predetermined time, the stack normal force will be maintained at a high level and the feeding procedure stopped. See Col. 1, lines 59–68.

U.S. Pat. No. 4,568,075 to Bothner discloses a sheet registration and clamping apparatus comprising a first position where a registration portion intercepts and stops a sheet moving along a travel path at a registration location. During this stage, a sheet clamping portion and sheet guiding portion are inoperative. Also provided is a second position where the sheet clamping portion secures a registered sheet at a registration location. Furthermore, a third position is provided where the clamping portion releases the registered sheet and a sheet guiding portion guides the sheet as it moves downstream.

U.S. Pat. No. 3,981,493 to Klappenecker et al discloses an apparatus comprising a withdrawing mechanism which supplies a document from a stack to a standby position determined by a sensor. The document is advanced by the withdrawing mechanism form the standby position into a gripping zone of a feed mechanism only when a call signal is applied to a control circuit. See Col. 1, line 66-Col. 2, line 3.

U.S. Pat. No. 4,728,966 to Piatt et al. discloses an apparatus comprising a first detector for sensing a forward edge at a predetermined start position, a second detector for sensing an engagement condition, a third detector for sensing a document st tus within a print path, and a contol system for receiv g the detectors' signals and determining error conditions. See Col. 1, lines 60–68.

In the description herein the term "document" or "sheet" refers to a usually flimsy sheet of paper, plastic, or other such conventional individual image substrate, and not to microfilm or electronic images which are generally much easier to manipulate. The "document" is the sheet (original or previous copy) being imaged, or copied in the copier onto the "copy sheet", which may be abbreviated as the "copy". Plural sheets of documents being imaged as a group in some desired related arrangement, even if not in an actual page order, or their copies, are referred to as a "set". A "duplex" document is a sheet desired to be copied on both sides, as opposed to a "simplex" or single side imaged document.

A specific feature of the specific embodiment disclosed herein is to provide, a document feeder with a document input area into which a document may be manually initially inserted and released, with a document sensor in said document input area for sensing said manually inserted document, said document feeder further including clampable feeding nip means automatically actuable in response to said document sensor document sensing for automatically clamping said manually inserted document in a feeder nip, and automatically actuable means for feeding said document automatically, the improvement comprising: control means providing a first time delay period between said sensing of said manually inserted document by said document sensor and said automatic actuation of said clampable feeding nip means, said control means further providing a second time delay period between said automatic actuation of said clampable feeding nip means and said automatic actuation of said means for feeding said document automatically, to provide for improved operator document manual insertion of the document.

Further specific features disclosed herein, individually or in combination, include those wherein said document feeder includes an automatically actuable operator display indicative of sensing of said manual document insertion by said document sensor, and said control means provides a preset time delay between said sensing of said manually inserted document by said document sensor and said automatic actuation of said operator display, and/or wherein said clampable feeding nip means for automatically clamping said manually inserted document in a feeder nip clamps said document with a limited initial nip force sufficiently low to allow manual document retraction without document damage during said second time delay period.

Further specific features disclosed herein, individually or in combination, include a method of document feeding in which a document may be manually initially inserted into a document input area and released, which document is sensed in said document input area by a document sensor, and then said document is automatically clamped in a document feeding nip which is automatically actuated in response to said document sensing, and then said document is automatically fed, the improvement comprising: providing a first time delay period between said sensing of said manually inserted document by said document sensor and said automatic clamping of said document in said feeding nip, and further providing a second time delay period between said automatic clamping of said document in said feeding nip and said automatic feeding of said document, to encourage and provide for improved operator document manual insertion of the document and/or wherein said document sensing automatically actuates an operator display indicative of said sensing, of said manually inserted document by said document sensor after said document display; and/or wherein said document feeder of said automatic clamping nip clamps said document with a limited initial nip force sufficiently low to allow manual document retraction without document damage during said second time delay period.

Another (alternative option) disclosed feature is to provide a document feeder in which a document may be manually initially inserted, having a document sensor operatively connecting with an actuable operator display indicative of sensing of said document insertion, and further including means for automatically clamping said manually inserted document in a feeder nip for subsequently feeding said document automatically, the improvement comprising control means providing a first time delay between said sensing of said manually inserted document and said actuation of said operator display, said control means further providing a second time delay after said actuation of said operator display before said automatic clamping of said feeder nip, so as to provide sufficient time for proper operator document insertion before operator release of the document.

The disclosed apparatus may be readily operated and controlled in a conventional manner with conventional control systems. Some additional examples of control systems for various prior art copiers with document handlers, including sheet detecting switches, sensors, etc., are disclosed in U.S. Pat. Nos.: 4,054,380; 4,062,061; 4,076,408; 4,078,787; 4,099,860; 4,125,325; 4,132,401; 4,144,550; 4,158,500; 4,176,945; 4,179,215; 4,229,101; 4,278,344; 4,284,270, and 4,475,156. It is well known in general, and preferable, to program and execute such control functions and logic with conventional software instructions for conventional microprocessors. This is taught by the above and other patents and various commercial copiers. Such software will of course vary depending on the particular function and the particular software system and the particular microprocessor or microcomputer system being utilized, but will be available to or readily programmable by those skilled in the applicable arts without undue experimentation from either verbal functional descriptions, such as those provided herein, or prior knowledge of those functions which are conventional, together with general knowledge in the software and computer arts. Controls may alternatively be provided utilizing various other known or suitable hard-wired logic or switching systems. As shown in the above-cited art, the control of exemplary document and copy sheet handling systems in copiers may be accomplished by conventionally actuating them by signals from the copier controller directly or indirectly in response to simple programmed commands and from selected actuation or non-actuation of conventional copier switch inputs by the copier operator. The resultant controller signals may conventionally actuate various conventional electrical solenoid or cam-controlled sheet deflector fingers, motors or clutches in the copier in the selected steps or sequences as programmed. Conventional sheet path sensors, switches and bail bars, connected to the controller, may be utilized for sensing and timing the positions of documents and copy sheets, as is well known in the art, and taught in the above and other patents and products. Known copying systems utilize such conventional microprocessor control circuitry with such connecting switches and sensors for counting and timing and thereby controlling the operation of the document and copy sheet feeders and inverters, etc..

All references cited in this specification, and their references, are incorporated by reference herein where appropriate for appropriate teachings of additional or alternative details, features, and/or technical background.

Figure 2:
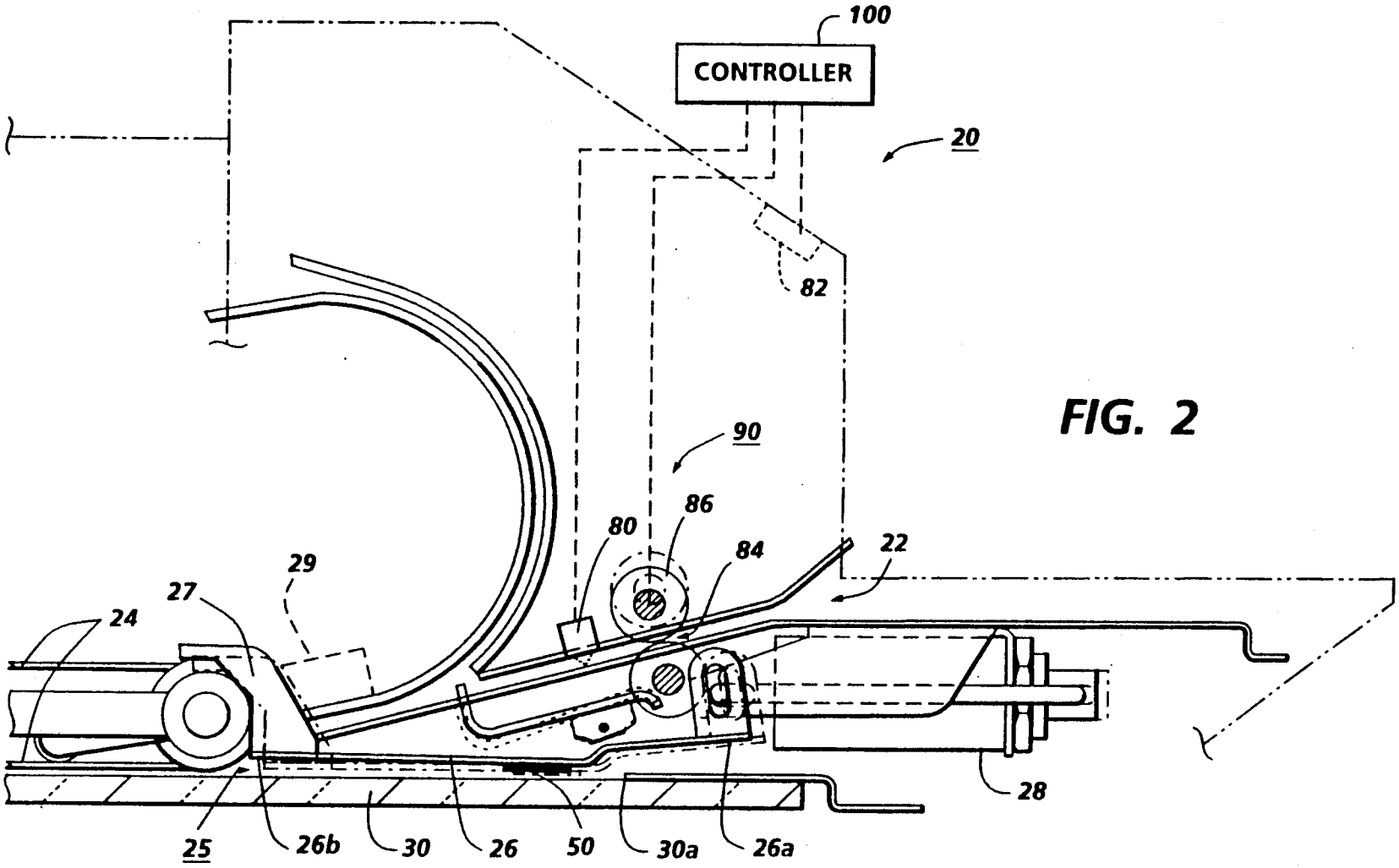
Figure 3:
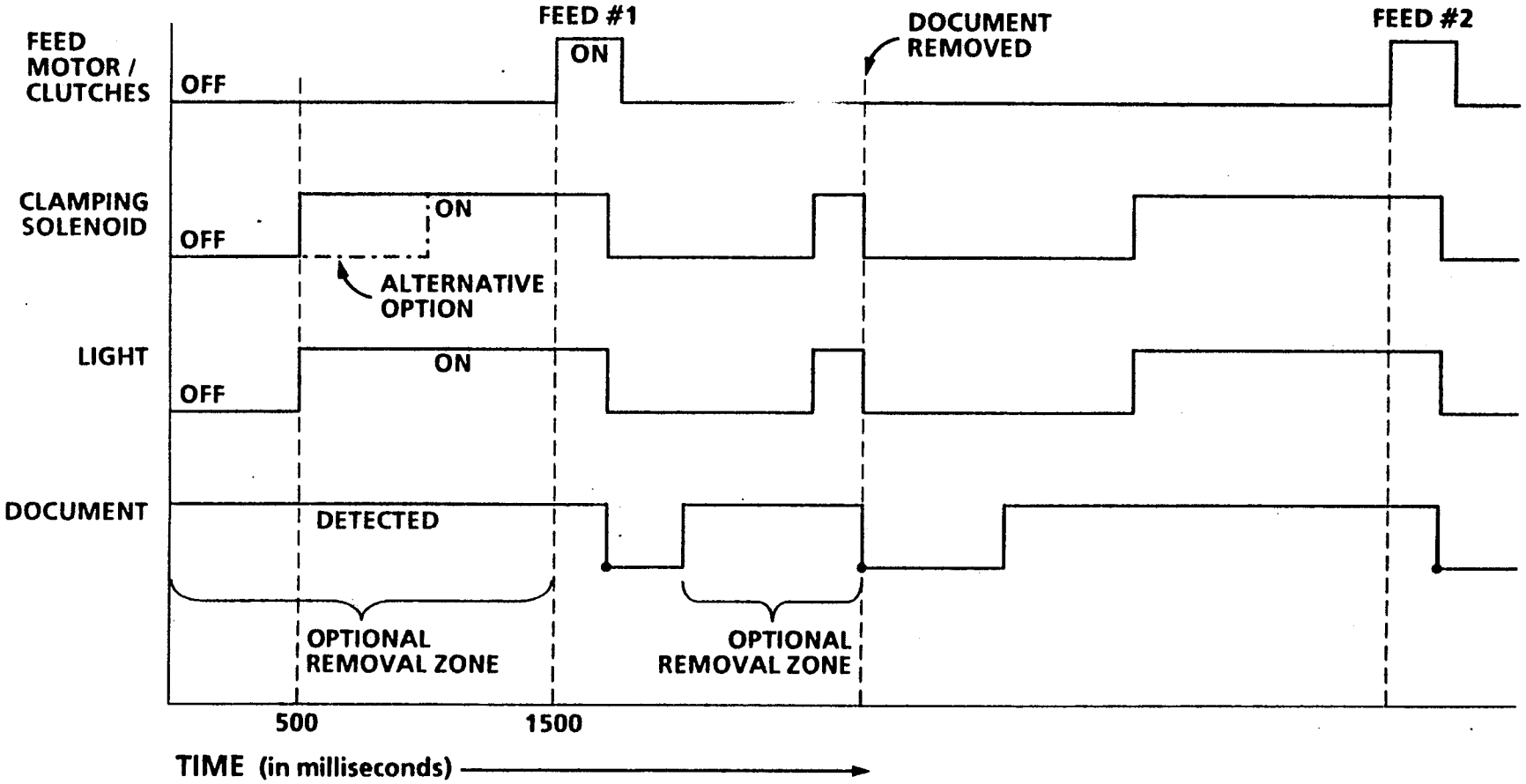

Another example of a frictional document feeder with automatic nip opening and closing relative to document insertion is Xerox Corporation U.S. Pat. No. 4,485,949, issued Dec. 4, 1984 to Steven A. Gebhart, et al. (D/82091). Various of the above-mentioned and further features and advantages will be apparent from the specific apparatus and its operation described in the example below, as well as the claims. Thus the present invention will be better understood from this description of an embodiment thereof, including the drawing figures (approximately to scale), wherein:

FIG. 1 is a schematic front view of one embodiment of the system of the invention, showing an exemplary dual mode RDH/SADH document handler with one example in the SADH input of a user-friendly manual document insertion assistance control system therefor; and FIG. 2 is a an enlarged partial view of the embodiment of FIG. 1; and FIG. 3 an exemplary timing chart for such an exemplary system, for two successive document loadings, with an intervening operator document removal, and an option of delayed clamping.

Describing now in further detail the exemplary embodiment with reference to the figures, this disclosed control system 90 is shown as a part of an exemplary integral document handling and imaging or copying system 10 with a recirculating document handler 20 shown by way of one example of a document handler for use with and/or control by the subject document detection and control system.

The RDH 20 may be generally conventional and may be mounted to, as a part of, any conventional copier or imager. Furthermore, the present system 90 is applicable to numerous other sheet feeding systems, of which this is merely one example. Further exemplary details are described in the above-cited and other references, and need not be repeated herein.

This otherwise conventional dual mode document sheet handler 20 may be for in one mode for RDH precollation copying, in which a stack 14 of individual flimsy document sheets are loaded into the generally horizontal and planar bottom surface of a restacking tray 16 to be fed seriatim from the bottom of the stack 14 by a vacuum belt or other individual sheet output feeder 17, assisted by an air knife, as shown, both of which are adjacent the front or downstream edge of the stack 14. Each sheet, after it has been fed out to the copier platen and copied, is returned via a restacking feeder or transport which feeds the returning sheet in over the top of the stack 14 from the rear of the stack and releases the sheet to restack by settling down on top of the stack between aligning edge guides. Thus, the document sheets can be continuously recirculated, in the same order, as often as desired.

However, the disclosed dual mode document registration document handler 20, also has a special, different, SADH input 22 and mode of operation for manually inserted documents illustrated in the subject example. That input can include computer form web (CF) and large documents, e.g., 11"×17" or A3 documents. In this document handler or feeder 20, manually inserted single documents are preferably initially inserted by the operator into the alternative side entrance or SADH slot 22 of the document handler 20, as compared to normal size documents, which may be inserted there, but more typically are stacked in the top or RDH stacking tray 21. However, this is merely exemplary, and the present invention is not limited to any particular type of document handler or document feeder.

The illustrated exemplary document handler 20 is an dual input RDH/SADH unit very much like that shown in the above-cited Xerox U.S. Pat. No. 4,579,444, issued Apr. 1, 1986, although FIG. 1 there is a reversed, mirror image, or rear view as compared to FIG. 1 here. Thus, this RDH/SADH 20, including its exemplary side or SADH entrance 22, may be basically as described in that patent, except as to the novel aspects described herein. Likewise, the RDH/SADH 20 and its drives and sensors are generally conventionally connected to and controlled by a conventional programmable controller 100, programmed as further described herein.

Normally, as described in the cited and other art, once the document is initially loaded into the SADH document input area 22 there is an automatic feeder nip closure, and then, automatically, this alternate SADH document entrance 22 path feeds the document from there to the upstream end of the platen transport belt 24 and onto the platen 30 at an infeeding position 25 there.

Just upstream of this document infeeding position 25 here is another conventional document edge optical sensor 29 (corresponding to reference 31 in the cited U.S. Pat. No. 4,579,444). [In this particular RDH 20, an underlying pivotal infeeding area light reflective baffle 26, preferably liftable by a solenoid 28, closely overlays the platen 30 in the area thereof extending from the platen upstream edge 30*a* to the infeeding position 25].

The disclosed electronic document imaging system 11 may be utilized in lieu of a conventional light-lens imaging system for electronic document imaging for a subsequent or integral printer. The electronic optical scanning system 11 reads document images on the imaging platen 30. As disclosed here schematically in FIG. 1, an exemplary electronic image scanning system 11 may be provided scanning from under the platen 30 with a scanner 40 which may be mounted on the reciprocally driven by a typical horizontal optical scanning carriage. The electronic image scanning system 11 here provides for scanning up to the full length or the entire area of the platen 30, from the ends 30*a* to 30*b*, (see the movement arrows) to be able to image a document of any size which can be fitted onto the platen 30 upper surface. Conventionally, a document illuminating lamp and reflector light source may be located on the same scanning carriage.

The electronic imaging member 40 may be a conventional imaging bar or scan head CCD sensor array. Such electronic digitizing of the document image, for integral or separate digital copying, printing, facsimile transmission, and/or other digital image processing, enhancement, and/or manipulation, is well known. This is sometimes called an "EFE" or "electronic front end". Above-cited examples included Xerox Corporation U.S. Pat. Nos. 4,757,348, 4,295,167 and 4,287,536. The electronic image scanning may be bidirectional, as is known for example from Eastman Kodak U.S. Pat. No. 4,150,873 issued Apr. 24, 1979 to G. Dali and Xerox Corporation U.S. Pat. No. 4,205,350. Also, various electronic buffer and page collation systems may be connected to or made a part of the EFE, as disclosed in above-cited references, IBM Corp. U.S. Pat. Nos. 4,099,254 or 4,213,694; Eastman Kodak Canadian 1,086,231 or UK 1 531 401; the Xerox Corporation "1200" and "9700" printers, etc..

With document handler 20, normal sized documents are fed and registered and ejected entirely unidirectionally on the platen 30, in a generally conventional manner, with the servo-driven non-slip platen transport belt 24. Thus, normal size automatically fed documents are registered in a registration position entirely under the platen transport belt 24, downstream from the baffle 26.

However, with this particular document handler 20, a large oversize document (only) is initially fed onto the platen 30 in the same manner and direction but then may be automatically treated differently, in accordance with being sensed as being oversized as it is fed in. The large document feeding continues until the downstream or lead edge area of the large document is overfed past the downstream end 30*b* of the platen (so that the lead edge area of the document actually briefly enters into the document exit or post-platen ejecting area 31). At that point in time, the trail edge of the oversized document has passed the upstream document edge sensor 29 and the downstream edge 26*b* of the baffle 26 in passing through the infeeding position 25 so that the length and oversized nature of that document is known by the copier controller 100. An oversized document includes any document which, at the feed-in point, exiting the infeeding position 25, would have any portion thereof extending beyond the downstream edge 30*b* of the platen 30, and would be imaged that way if handled as a normal document. In response to that oversize information, the document platen transport is automatically reversed (but preferably operated at a much slower reverse speed than the forward speed), and the document is "backed-up" into a desired copying position registered relative to the upstream platen edge 30*a*. That reverse document movement into the large document copying position moves the trail edge area of the large document back under the infeeding baffle 26 towards the upstream edge 30*a* of the platen. The backing-up of a document, and the coordinated lifting of the baffle 26 downstream end 26*b* by solenoid 28 as described herein, is automatically actuated only for documents which are sensed as being oversized. All documents are feed in onto the platen 30 through the normal SADH or RDH input path guide baffles leading to input area 25, as shown, which baffles are above the baffle 26.

In the example here, the solenoid 28 is connected to the upstream end 26*a* of the baffle 26, and horizontal movement downstream of the baffle 26 by actuation of the solenoid 28 lifts the downstream lip 26*b* of the baffle 26 away from the platen 30 and above the plane of the platen transport belt 24 lower flight. In that raised position, the baffle lip 26*b* and associated (now inclined) lower surface of this baffle 26 in effect becomes a stripping gate or deflector to ensure that the previously trailing edge of the now reversed movement large document will back up under, rather than over, the baffle 26.

When the solenoid 28 is not actuated, the baffle 26 is dropped or lowered into its normal generally horizontal position directly overlying the platen 30, by being lowered substantially into that plane. Preferably the lower surface of the baffle 26 is normally allowed to rest directly and flatly on the platen 30 upper surface by gravity when the solenoid is 28 is disengaged. i.e., preferably here the input path of a large document as well as a normal document is above or over the top of the baffle 26, and with the baffle in its lowered position, as previously noted. In the case of normal sized documents, the solenoid 28 need never be actuated and the baffle 26 can stay down flat directly on top of the area of the platen it overlies at all times.

Turning to the disclosed example of the specific system 90 of the invention, this control system 90 includes an SADH document input, presence sensor 80 connected to the controller 100. So is a display lamp 82 activated by the sensor 80. The sensor 80 is located to activated by a document edge area being sufficiently initially grossly aligned and deskewed within the SADH document input area 22 as to be within the clamp or nip 84 of solenoid clampable feed rollers 86, also controlled by controller 100.

The disclosed embodiment 90 provides a modification of the normal algorithm controlling the nip 84 closing and feeding operations of the document handler 20, particularly to allow a preset time lapse before the clamping action of the nip 84 before the document is fully committed to the sheet feeder 86. This provides the operator with an option of, and time period for, removing or realigning the document, if desired, without force and without damaging the document. Preferably in addition to delaying the clamping action 84, a conventional operator LED or other lamp 82 or other signal that a document has been inserted is also delayed, to also encourage and allow full manual insertion and deskewing of the document by the operator. This manual initial alignment and deskewing may be to or against a lateral side edge guide, as is well known, in addition to sufficient insertion of the lead edge of the document into or against a registration gate or line in the document feeder to ensure positive feeding after the nip 84 of the feeder rolls 86 (or belts) is closed to engage the document. The clamping referred to may be the single closing of the first feeding nip 84, but may also, or in addition, include the closing of a normal force bail, pad, or other member down against the document sheet, particularly if more than one document is being loaded at a time. I.e., if a stack of documents is being loaded into the document feeder rather than an individual document.

The illustrated SADH input or by-pass slot 22 includes a conventional input feeding nip 84 that is in effect "grabs" the document lead edge area after it is initially manually pre-registered therein. The document is then fed forward into the system using the conventional appropriate clutches and drive motors driving the feed rollers 86.

Traditionally, this input feeding nip is closed after the document is "seen" by the conventional sensor in the input area and then immediately fed. Traditionally, once this nip is closed the operator is not given a subsequent chance to remove the document. That is, even if the operator was not satisfied with the document orientation in the input slot, or other possible problem with the process, or simply decided to remove the document for any reason, it is too late, the document is committed to the paper path with no simple method of aborting the commitment. That is, conventionally the document is committed at the time of the initial nip closure process, and any attempt at removal or reinsertion or manual further pushing into the document after that point could lead to document damage due to the nip remaining closed on the document. This, or the operator continuing to hold on to the document and resisting the feeding can lead to a document handling fault (jam signal). That may then typically require the operator to follow through what may be a fairly lengthy fault recovery scenario instructions. Furthermore, if a document were strongly pulled out of the operator's hand by the automatic feeder, it might even in rare cases cause a paper edge cut of the operator's hand.

In contrast, in the present system the input to this SADH or other document input can be made much more "forgiving" to the operator, in the sense that improperly and manually preregistered documents in the nip area can be removed by the operator without either document damage or the need for a fault recovery procedure.

Preferably, the nip or clamping force 84 here is sufficient to hold the document in the slot, even if it is a heavy CFF document, but insufficient to cause document damage if the document is forcibly removed from the nip area.

The preferred control sequence for the SADH document input 22 is as follows: The document is not clamped until the input sensor 80 first sees a document grossly registered in the SADH or by-pass slot 22 input for a predetermined time period. Once this first time period has expired, the document is clamped, and a second time period (delay) is started. After the second time period has passed, the document is considered committed to the paper feeding process and is automatically fed 86. However, during this second time period between the clamping of the document and its feeding, the operator still can, with minimal difficulty, remove the document from the nip area and avoid feeding it, due to the abovedescribed relatively low nip clamping force. In that case the nip area sensor would no longer see a document in the input slot. Here the nip 84 is then released automatically and the document procurement process is reset without any document handler fault being declared. The operator can repeat this process as many times as necessary or desirable until the operator is comfortable that the document is being clamped properly and/or is properly initially aligned, and the operator wishes to release the document for feeding.

This system increases the operator's perception of the apparatus as being more reliable. The chances of a document feeding fault are minimized, due to the higher probability that the document will be properly oriented before actually attempting to feed. This increases the effective throughput of documents and reduces operator frustrations. As indicated, document damage is also minimized because of the greater operator flexibility and the lower normal or clamping forces in the nip area, i.e., the nip force is sufficiently minimal so that the document is not damaged by the operator continuing to hold on to the document, or even pulling the document back out of the input area after clamping.

Furthermore, it may be seen that this described system automatically conforms to the operator skill level in feeding documents. That is, it allows a skilled operator to load and release documents at a rapid rate, whereas it allows a novice operator unfamiliar with the document feeder to use as many refeeding or reloading attempts as desired.

It will be appreciated that both of the respective time delays may be, conventionally, simple software counts in buffers, or otherwise, utilizing the sequential clock pulses input of the copier controller 100. Of course, this may also be provided by separate conventional time delay circuitry in the document handler itself, if desired. Optimum operator-friendly first and second time delays as described herein may be preselected based on "human factors" testing for the particular document feeder. The sensors and displays may all be conventional.

Suitable relatively low force nips in which a sheet may be pulled out of the closed nip without damage are known per se in various other applications. Alternatives include foam rollers, soft elastomers, low force or low weight pivotal and/or feed rollers or feed belt shafts, frictional or magnetic low force reversible (slip) clutches on the feed roller shaft, etc. Various feeders and registration or alignment systems and input sensors are shown in the above-cited patents or various other known document feeding art.

Preferably the "polling" or electronic interrogation of the document input sensor 80 output by the controller 100 is done plurally at a fixed time period rate. This acts as a filter for avoiding erroneous readings due to sensor noise or disturbance anomalies.

While the embodiment disclosed herein is preferred, it will be appreciated from this teaching that various alternatives, modifications, variations or improvements therein may be made by those skilled in the art, which are intended to be encompassed by the following claims:

I claim:

1. In a document feeder with a document input area into which a document may be manually initially inserted and released, with a document sensor in said document input area for sensing that said manually inserted document has been properly inserted, said document feeder further including automatically releasable gate means against which said manually inserted document is inserted and initially aligned, and clampable feeding nip means defined by feed rollers upstream of said gate means which are initially spaced apart to form an open nip through which said manually inserted document is insertable to engage said gate means, said clampable feeding nip means being automatically actuatable in response to said document sensor document sensing for automatically clamping said manually inserted document in a feeder nip by clamping said open nip of said feed rollers together to form a closed nip, and automatically actuatable means for feeding said document automatically by rotatably driving at least one of said feed rollers, the improvement comprising:

control means providing a preset automatic first time delay period between said sensing of said manually inserted document by said document sensor and said automatic actuation of said clampable feeding nip means, said control means further providing a preset automatic second time delay period between said automatic actuation of said clampable feeding nip means and said automatic actuation of said means for feeding said document automatically, and wherein said clampable feeding nip means for automatically clamping said manually inserted document in a closed feeder nip of said feed rollers clamps said document with a limited initial nip force sufficiently low to allow manual document retraction without document damage during said second time delay period, to provide for more user-friendly operator manual insertion of said document.

2. The document feeder of claim 1, wherein said document feeder includes an automatically actuable operator display indicative of sensing of said manual document insertion by said document sensor, and said control means provides a preset time delay between said sensing of said manually inserted document by said document sensor and said automatic actuation of said operator display.

3. The document feeder of claim 1, wherein if said document sensor senses before the end of said second time delay that a document is no longer being inserted in said document input area then said control means is automatically reset for another manual document insertion.

4. In a document feeder in which a document may be manually initially inserted, and initially aligned against automatically releasable gate means, through an open nip of opposing feed rollers upstream of said gate means, having a document sensor operatively connecting with an actuatable operator display indicative of sensing of said document insertion through said open nip, and further including means for automatically clamping said manually inserted document in a feeder nip by clamping said open nip of said feed rollers together to form a closed nip and automatically releasing said gate means for subsequently feeding said document automatically by rotatably driving at least one of said feed rollers, the improvement comprising:

control means providing a preset automatic first time delay between said sensing of said manually inserted document by said document sensor and said actuation of said operator display, said control means further providing a preset automatic second time delay after said actuation of said operator display before said automatic clamping of said feeder nip of said feed rollers, and said control means further providing a preset automatic third time delay before said automatic document feeding by said rotatably driving at least one of said feed rollers, in which third time delay said means for automatically clamping said manually inserted document in said closed feeder nip clamps the document with a sufficiently low nip force to allow manual document retraction without document damage, so as to provide sufficient time for proper and more user-friendly operator document insertion before operator release of the document.

5. The document feeder of claim 4 wherein if said document sensor indicates at any time before the end of said third time delay that a document is no longer being inserted, then said control means is reset for another manual document insertion with said same time delays.

* * * * *